United States Patent [19]

Dilmore

[11] Patent Number: 4,893,811

[45] Date of Patent: Jan. 16, 1990

[54] EXERCISER

[76] Inventor: Clayton D. Dilmore, 8325 Capps Ave., Northridge, Calif. 91324

[21] Appl. No.: 295,993

[22] Filed: Jan. 12, 1989

[51] Int. Cl.[4] ..... A63B 21/24

[52] U.S. Cl. ..... 272/129; 272/134; 128/25 R

[58] Field of Search ..... 272/129, 134, 117; 128/25 R

[56] References Cited

U.S. PATENT DOCUMENTS

| | | | |
|---|---|---|---|
| 4,296,924 | 10/1981 | Anzaldua et al. | 272/134 X |
| 4,456,245 | 6/1984 | Baldwin | 272/134 X |
| 4,518,163 | 5/1985 | Bruder | 272/134 X |
| 4,732,381 | 3/1988 | Skowronski | 272/134 |
| 4,751,440 | 6/1988 | Dang | 272/129 X |
| 4,778,175 | 10/1988 | Wucherpfennig et al. | 272/129 |

FOREIGN PATENT DOCUMENTS

| | | | |
|---|---|---|---|
| 3424499 | 1/1986 | Fed. Rep. of Germany | 272/129 |
| 3635528 | 4/1988 | Fed. Rep. of Germany | 272/129 |
| 2581552 | 11/1986 | France | 272/129 |
| 0225914 | 8/1985 | U.S.S.R. | 272/129 |

*Primary Examiner*—Richard J. Apley
*Assistant Examiner*—Joe H. Cheng, Jr.
*Attorney, Agent, or Firm*—Jack C. Munro

[57] ABSTRACT

An exercising machine which uses an electromagnet assembly as the resistance to be overcome in moving of the movable section of the exerciser relative to the fixed section of the exerciser. This electromagnetic assembly can be adjusted so that the force required to be overcome in moving of the movable section relative to the fixed section can be increased or decreased. The force encountered is maintained constant during moving of the movable section relative to the fixed section.

1 Claim, 1 Drawing Sheet

EXERCISER

BACKGROUND OF THE INVENTION

The field of this invention relates to an exercise apparatus and more particularly an exercise apparatus which utilizes electromagnets as the resistance to be overcome by the user in operating of the exercising apparatus.

Exercising equipment has long been known. At the present time, there are a great number of exercising facilities available to t he public. It is common within each of these exercising facilities that there is a substantial number of these exercising machines. Generally, an exercising machine is designed to exercise a particular muscle group. The most common form of such an exercising machine utilizes fixed base upon which is mounted a movable section. Movement of this movable section by the user is what produces the desired exercising of that muscle group. Resistance is applied against the movable section generally in the form of a series of weights. The disadvantage of using these weights is that the resistance is not constant but is only in one direction. In working any muscle group, complete working of the muscle group can be achieved by only moving against the resistance in one direction and then moving against the resistance in the opposite direction.

At the present time, a single machine is designed to work a muscle group by movement in one direction only. In order to work the same muscle group in the opposite direction, it is necessary to have a completely separate machine that is specifically constructed to operate in the opposite direction. Therefore, in the past, two completely separate machines are required to completely exercise this single muscle group.

SUMMARY OF THE INVENTION

The structure of the present invention is directed to an exercising machine wherein complete exercising of a single muscle group is achieved without requiring of a completely separate piece of equipment.

The structure of the present invention utilizes a stanchion or stand which is to be fixedly located on a supporting surface. Mounted on this stand is a seat upon which a human being user is to be seated. Located in close proximity to the user is a movable section. This movable section is adapted to be grasped and pivotally moved either clockwise or counterclockwise. This movable section is mounted on a metallic plate. This metallic plate is located in close proximity to a plurality of electromagnets. The amount of energy being supplied to the electromagnets can be increased or decreased thereby increasing the overall resistance to be overcome or decreasing the overall resistance to be overcome in the moving of the movable section relative to the stand. By the user moving of the movable section in an oscillating manner, exercising motion results.

DETAILED DESCRIPTION OF THE SHOWN EMBODIMENT

Figure 1:
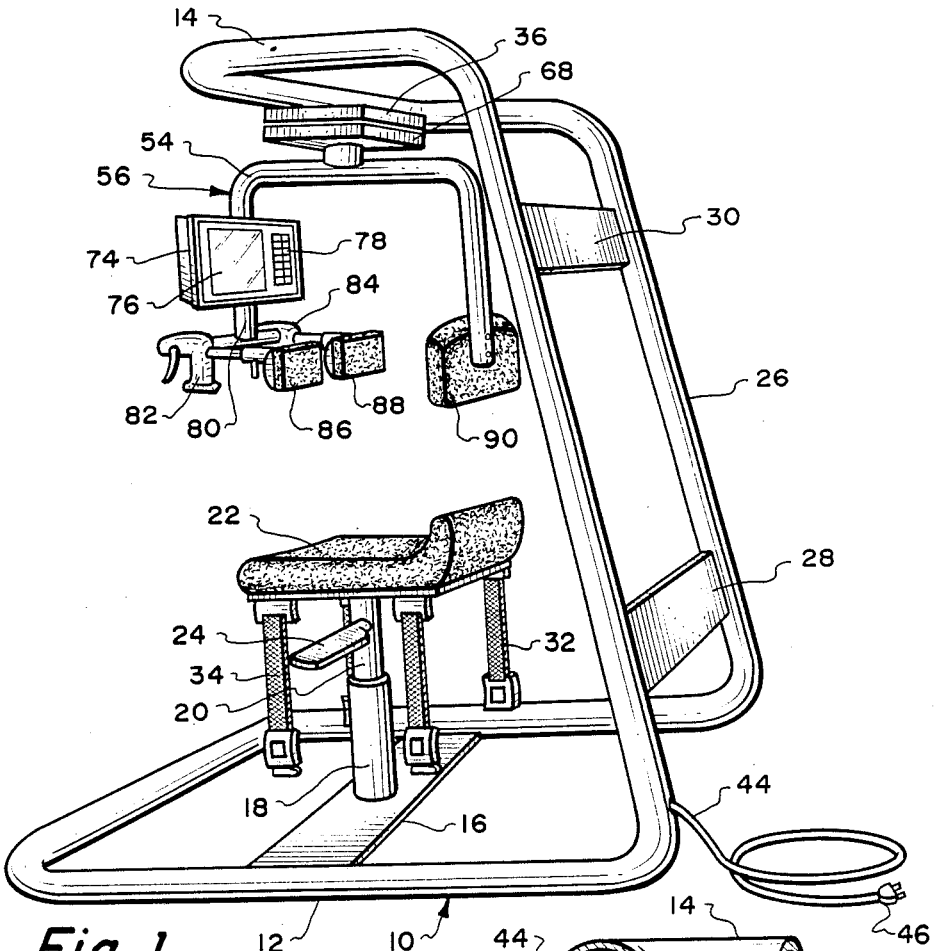
FIG. 1 is an isometric view of a type of exercising apparatus which is constructed to include electromagnets as the source of resistance to the performing of the exercising motion.
Figure 2:
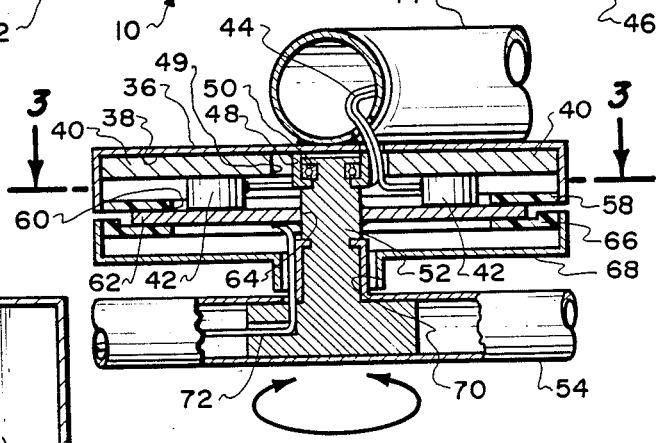
FIG. 2 is a cross-sectional view taken in a vertical plane through the electromagnetic assembly of the exercising apparatus of the present invention.
Figure 3:
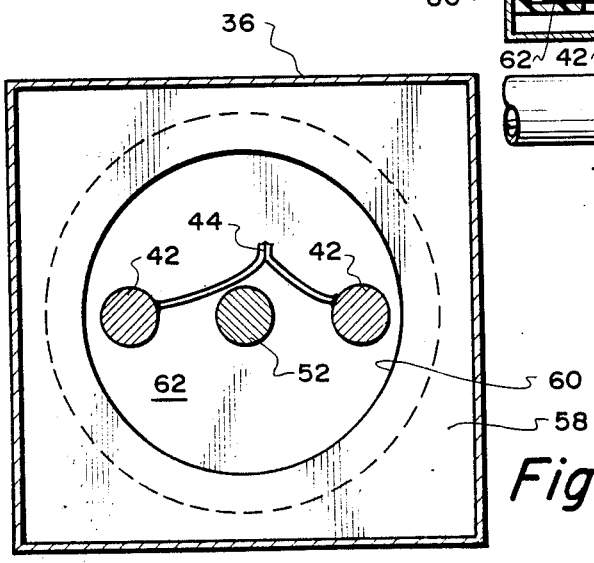
FIG. 3 is a cross-sectional view taken in a horizontal plane taken along line 3—3 of FIG. 2 showing in more detail the electromagnetic arrangement incorporated within the exerciser of this invention.

Referring particularly to the drawing, there is shown a stand 10 which is generally composed of tubular stock and has a base section 12 and a ceiling section 14. This base section 2 includes a base plate 16. Fixedly mounted on the base plate 16 is a post 18. Post 18 is hollow and has an open upper end within which is located in a close-fitting manner a seat post 20. The upper end of the seat post 20 is fixedly mounted to the undersurface of a seat 22. Seat 22 can be pivoted relative to the post 18 and once the desired position is obtained, it is locked by means of handle 24. The locking mechanism is deemed to be conventional and forms no specific part of this invention and therefore is not being described here in detail. The stand 10 also includes a back section 26 which interconnects the ceiling section 14 and the base section 12. The back section 26 includes bracing plates 28 and 30.

It may be desirable when the user is occupying the seat 22 and in the performing of the desired exercise that the user be fixed to the seat 22. In order to accomplish this, there may be utilized a seatbelt arrangement 32 and 34 in order to secure the user to the seat 22.

Fixedly mounted to the ceiling section 14 is a sheet material cover 36. Sheet material cover 36 defines an inner chamber 38 which has fixedly mounted therein a mounting plate 40. Fixedly mounted to the mounting plate 40 are a plurality of electromagnets 42. It is to be understood that though two in number of electromagnets 42 are shown that this number could be increased or decreased if such is deemed to be desirable. These electromagnets may be supplied electrical energy through conductor 44 which terminates in a plug 46 which is to connect in a conventional manner to a source of electrical energy (not shown).

Also mounted to the cover 36 and located within inner chamber 38 is a shaft mount 48. This shaft mount 48 is centrally located with respect to the cover 36 and is positioned directly adjacent the tubular member of the ceiling section 14. Shaft mount 48 is also centrally located relative to mounting plate 40. Shaft mount 48 is located within an enlarged hole 49 formed within mounting plate 40. Within the shaft mount 48 is located a bearing assembly 50. Rotatably supported by the bearing assembly 50 is the end of a shaft 52. The outer end of shaft 52 is fixedly mounted to tubular member 54 which is part of the movable section 56.

The peripheral edge of the cover 36 includes an inwardly extending flange 58. Centrally disposed within the flange 58 is an enlarged opening 60. A portion of 11 electromagnets 42 are located within this enlarged opening 60.

Connecting with the flange 58 is a metallic plate 62. Plate 62 is basically in the shape of a disc. The plate 62 includes a center opening 64 through which extends the shaft 52. Shaft 52 is fixedly secured to the plate 62. Plate 62 is located to just be slightly spaced from each of the electromagnets 42. The position of the flange 58 will prevent the plate 62 from actually coming into contact with the electromagnets 42 and will remain at this precise spacing.

The plate 62 abuts against a flange 66 of a bottom cover 68. Bottom cover 68 is fixedly secured to the cover 36 in some manner that is not shown. The shaft 52 passes through centrally located hole 70 formed within the bottom cover 68.

Mounted on the plate 62 will be a plurality of sensors (.not shown.). These sensors will be connected by electrical conductor 72 to a display 74. Display 74 includes a display screen 76 whose function is to display appropriate indicia having to do with the preset exercising program. The input to the exercising program can be supplied by the particular user through the use of button 78. One example of a particular type of indicia that can be preset and displayed within the display 76 would be the amount of resistance force that is required to be overcome in the moving of the movable section 56 relative to the stand 10.

Fixedly connected to the display 74 and extending therefrom is a mounting post 80. Mounted on the mounting post 80 are a pair of graspable handles 82 and 84. Associated with the handles 82 and 84 are a pair of pads 86 and 88. The pads 86 and 88 are individually movable toward and away from the handles 82 and 84. Pads 86 and 88 are to be positioned against the pectoral region of the user when exercising.

The movable section 56 may also include a backrest pad 90 which is to be located against the back of the user during the performing of the exercising procedure. This back section 90 is merely for the purpose of providing a desired amount of support. The purpose of :he pads 86 and 88 are to locate the user a desired spaced distance from the graspable handles 82 and 84.

It is to be understood that in operating of the exerciser of this invention that the user will grasp the handles 82 and 84 with the pads 86 and 88 resting against the forward portion of the user's shoulders. The user then proceeds to cause the movable section 56 to be pivoted clockwise and then counterclockwise. There will be resistance to movement in each direction with that resistance being supplied by the electromagnets 42. The resistance supplied by the electromagnets 42 can be increased or decreased by increasing or decreasing the electrical energy to the electromagnets 42 with this increase being physically selected by the user by punching of buttons 78.

What is claimed is:

1. An exerciser comprising:

a stand adapted to be fixedly located on a supportive surface, said stand including a ceiling section adapted to be located in a vertically spaced position above a human being user;

a sheet material cover fixed on said ceiling section, said sheet material cover having an inner chamber, a mounting plate being fixedly mounted on said sheet material cover, said mounting plate being located within said inner chamber;

a plurality of electromagnets mounted on said mounting plate a shaft mount fixedly mounted on said cover, said mounting plate including a central enlarged hole, said shaft mount located within said enlarged hole, a bearing assembly mounted within said shaft mount;

a shaft having an inner end and an outer end, said inner end connecting with said shaft mount, said shaft being rotationally supported by said bearing assembly, said outer end being fixed to a tubular member, pivotal movement of said tubular member is permitted by the rotational mounting of said shaft on said shaft mount;

said sheet material cover having a peripheral inwardly extending flange, said flange defining an enlarged opening, said electromagnet being partially located within said enlarged opening;

a metallic plate fixed to said shaft, said metallic plate covering said enlarged opening with the peripheral portion of said metallic plate abutting against said flange, said metallic plate being slightly spaced from said electromagnet with said flange preventing said metallic plate from deflecting and connecting said electromagnet;

said electromagnet and said metallic plate are adapted to supply a resistance in response to an electrical energy; and said tubular member permits said user to simultaneously rotate said shaft in either clockwise or counterclockwise direction and work against said resistance, whereby when said electrical energy is increased to said electromagnets, the amount of resistance is increased.

* * * * *